United States Patent [19]

Mae

[11] 4,043,261

[45] Aug. 23, 1977

[54] AUTOMATIC BANDING MACHINE

[75] Inventor: Shinroku Mae, Tokyo, Japan

[73] Assignee: Motosuke Umezu, Tokyo, Japan

[21] Appl. No.: 718,193

[22] Filed: Aug. 26, 1976

[30] Foreign Application Priority Data

May 19, 1976 Japan ..... 51-56653

[51] Int. Cl.[2] ..... B65B 13/04

[52] U.S. Cl. ..... 100/26; 100/4

[58] Field of Search ..... 100/4, 8, 25, 26, 33 PB; 53/198 R; 226/113, 187

[56] References Cited

U.S. PATENT DOCUMENTS

| | | | |
|---|---|---|---|
| 2,136,225 | 11/1938 | Williams | 100/26 |
| 3,447,447 | 6/1969 | Rutty | 100/4 |
| Re. 27,427 | 7/1972 | Leslie | 100/26 |

FOREIGN PATENT DOCUMENTS

| | | | |
|---|---|---|---|
| 879,189 | 10/1961 | United Kingdom | 100/26 |

*Primary Examiner*—Billy J. Wilhite

*Attorney, Agent, or Firm*—Wenderoth, Lind & Ponack

[57] ABSTRACT

An automatic banding machine for providing a smooth supply of packing band for banding around a package being banded, even to a big-sized arch. The machine has a base housing therein a packing band supplying device. An arch is provided on the machine base having a band running channel on the inside thereof. A band holding means is provided around the whole periphery on the inside of the arch, the band holding means being movable over the channel to form a chamber for the running band and covering the channel as the band advances and uncovering the channel when the band recedes. An auxiliary band feeder is provided midway of the arch and having a driving roll extending inwardly from the arch channel and rotating parallel to the direction of the movement of the band. A press roll is provided on the band holding means which contacts the driving roll when the band holding means advances.

5 Claims, 17 Drawing Figures

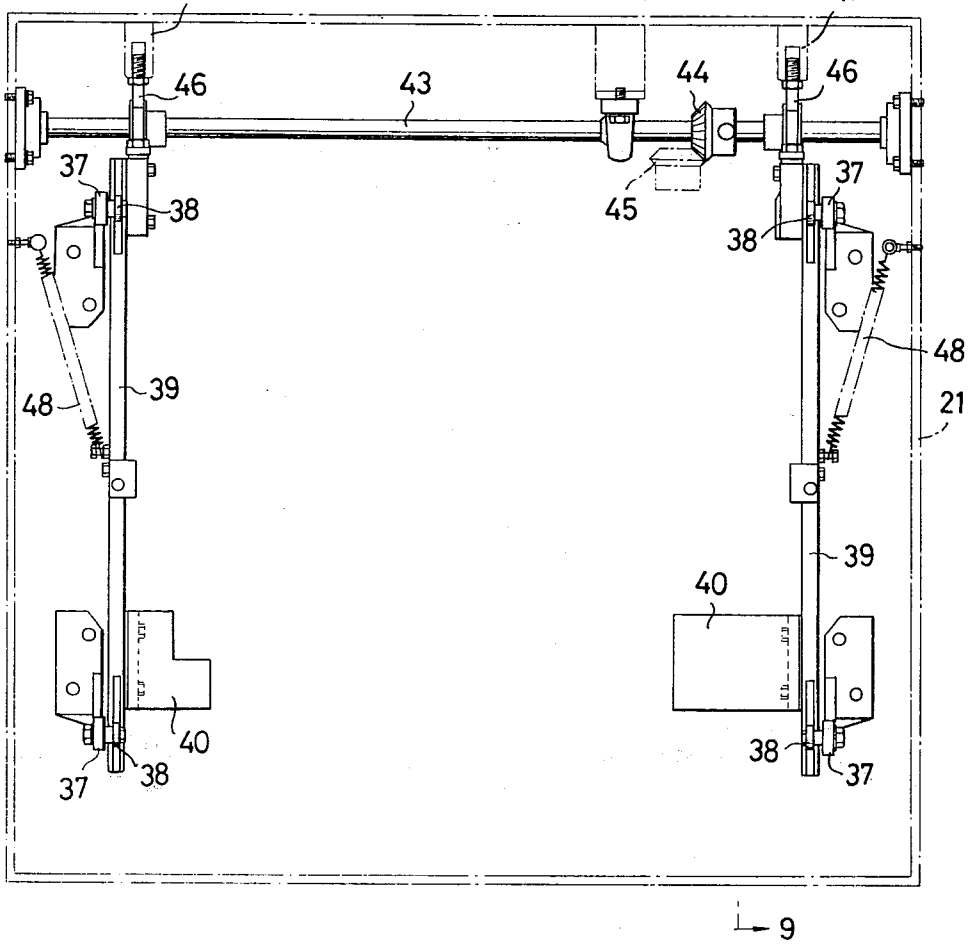
FIG.8
FIG.9
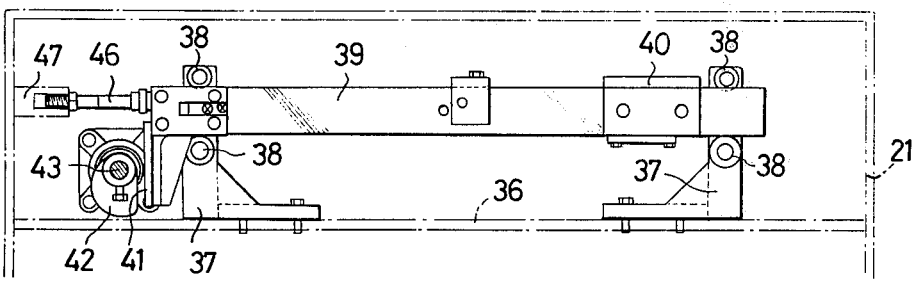

FIG.11
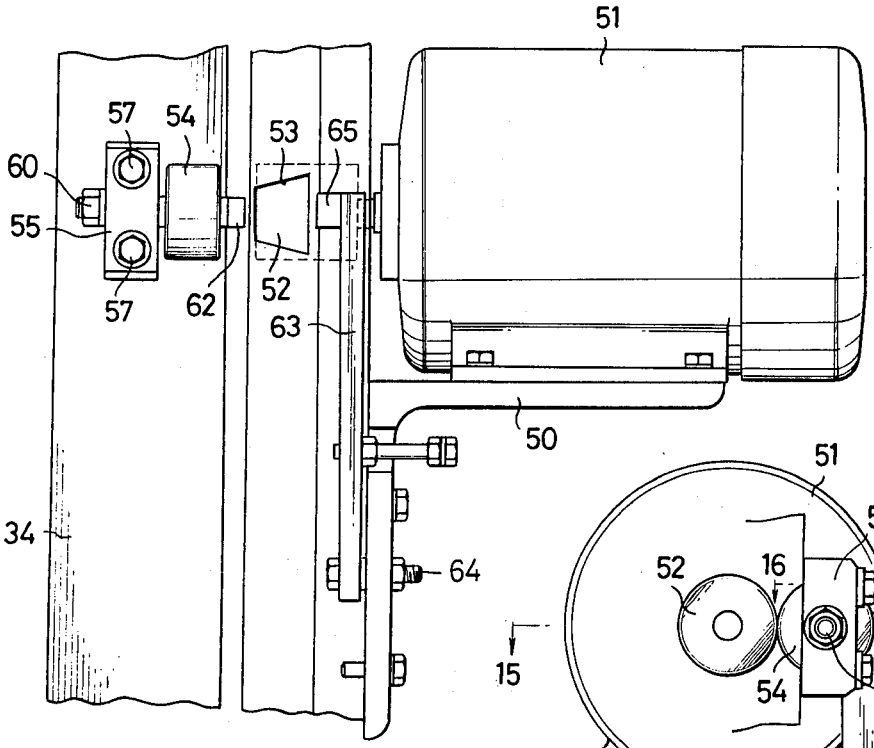
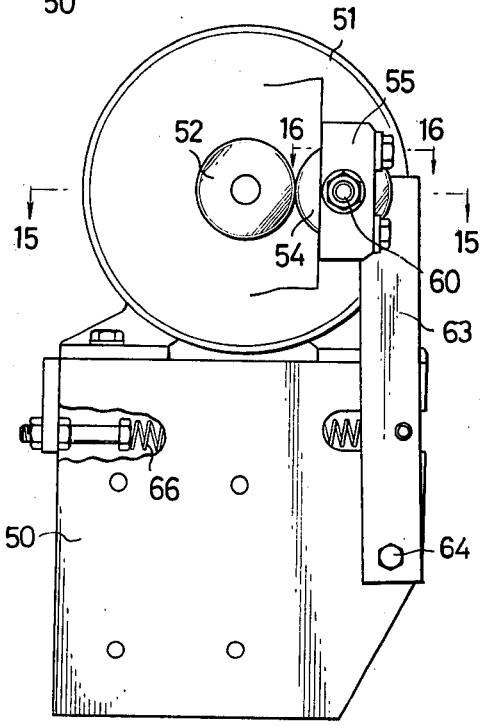
FIG.13

AUTOMATIC BANDING MACHINE

The present invention relates to an automatic banding machine, and more particularly relates to an automatic banding machine of the type which has an arch for supplying the band on a machine base to which the packing band is continuously supplied and in which the object to be banded is inserted into the said arch.

Banding tapes such as those made of steel, paper and thermo-plastic materials for banding packings and the like are being widely used. Bands made of thermo-plastic material are used because of their versatility due to their high tensile strength and flexibility, and also because it is possible to provide a stable supply thereof. However, when the band is supplied to the arch, the force required to run the band is increased due to the friction between the band and the arch channel, thereby slowing or stopping the running of the band where it depends only on the driving force of the feeder wheel housed in the machine.

The thickness of such a band is generally about 0.5 mm, and when a band of this thickness is used with a large sized arch such as 100 cm wide and 80 cm high, the band becomes stuck in the channel as the running distance necessarily becomes long and as the band sags and rubs against the channel. A band of more than 1 mm thickness has sufficient rigidity to help the smooth running of the band, even in a big-sized arch. However, a band of 0.5 mm thickness has sufficient tensile strength for packing purposes and it is completely uneconomical to increase the thickness merely to facilitate smooth running in the packing machine.

A banding machine with a big-sized arch can naturally be used to pack a big object, but when it comes to packing a small object, it is sometimes impossible to correctly wind the band around the object as it comes off the arch. In other words, when the feeder wheel is reversed to let the band come off the arch when tightening the band around the package, the band reaches the package quickly. At this time the band is wound around the package in a position inclined relative to the edge instead of being perpendicular thereto. A band tightened in such a way becomes loose after packing, and the package may not retain the band properly.

An object of the present invention is to provide an automatic banding machine including a device having a band holding means in the band running channel, and which supplies the band into a space formed by the band holding means and the channel; and further the band is let loose from the arch by pulling back the band holding means from the channel.

Another object of the present invention is to provide an automatic banding machine provided with an auxiliary band feeder which imparts drive to the band as it loses its running force on the path or channel around the arch and thus produces a smooth running of the band.

Another object of the present invention is to provide an automatic banding machine wherein the bottom of said arch channel is inclined to form a space with a cover for the said band holding means, thereby providing an "escape" for the band to facilitate a smooth running thereof.

Still another object of the present invention is to provide an automatic banding machine wherein a band guide is provided parallel to and inside the vertical portion of the arch to produce correct positioning of the band over the object being packed. The present invention will now be explained further in detail, reference being made to the embodiment shown in the attached drawings, wherein:

FIG. 8 is a plan view of the driving device for driving the band holding means;

FIG. 9 is a section taken on line 9—9 of FIG. 8;

FIG. 11 is a side view similar to FIG. 10 showing the band holding means pulled backward by the auxiliary band feeder;

FIG. 13 is a front view of the auxiliary band feeder;

Figure 1:
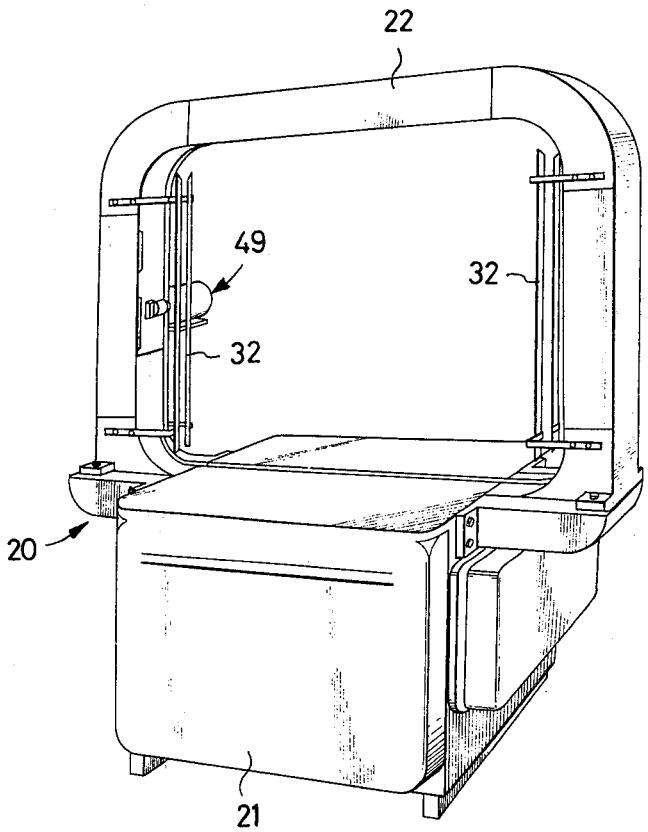
FIG. 1 is a perspective view of an automatic banding machine in accordance with the present invention.
Figure 2:
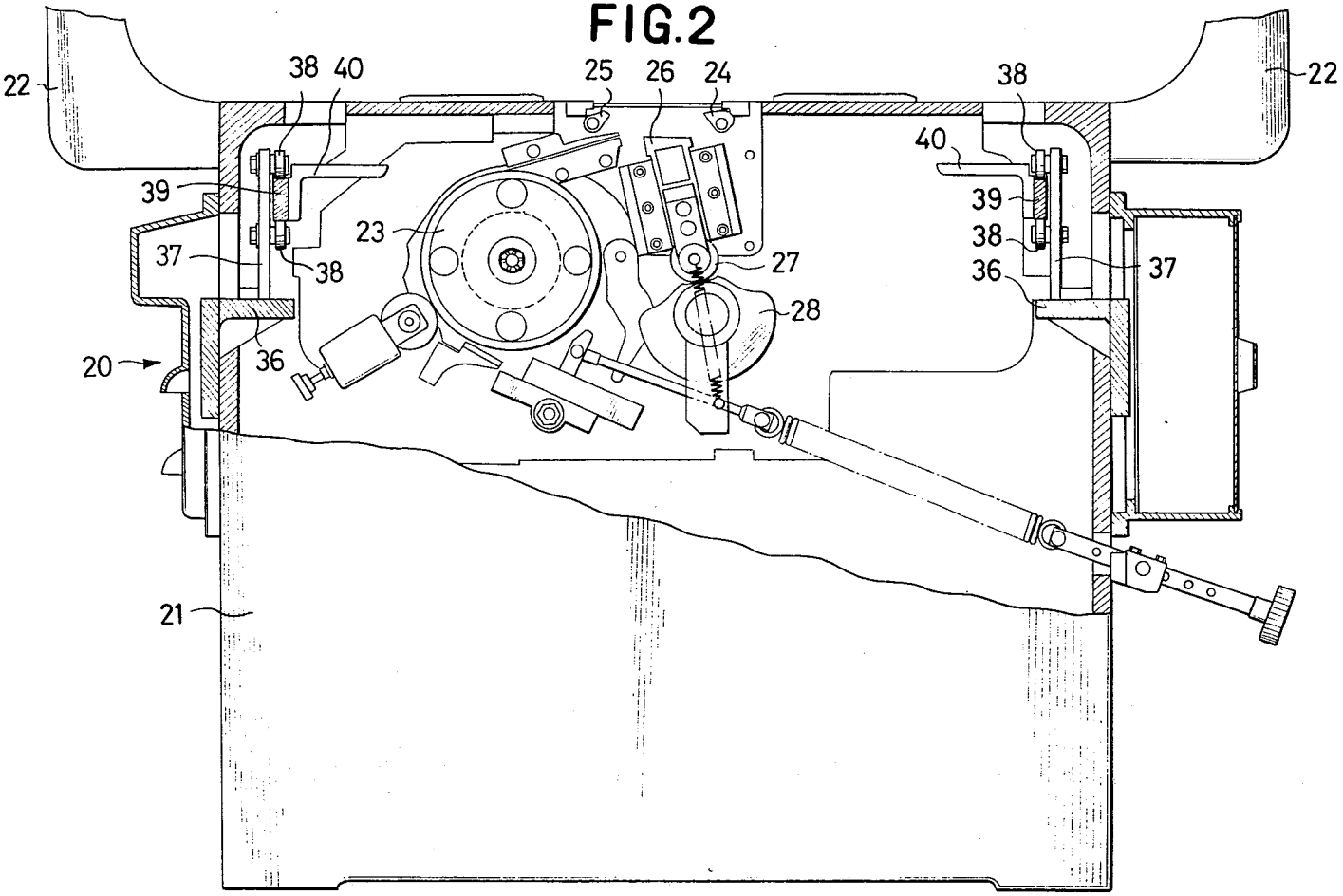
FIG. 2 is a front view of a portion of the machine base provided with a driving member for supplying the packing band to the arch placed on the machine base.

In FIGS. 1 and 2, an automatic banding machine 20 consists of the machine base 21 and the arch 22. In the machine base 21 is provided a feeder wheel 23 to supply the packing band to the arch. A band holding piece 24 is provided in the band supply channel near the top of the machine base. A band holding piece 25 to support the band is also provided in the band supply channel. A press piece 26 is located between the two holding pieces 24 and 25 at the lower end of which is provided a roll 27 adjacent to a cam wheel 28.

Banding is performed as the object being banded is positioned under the arch 22 and the packing band is supplied to the arch 22. The band is directed to the right-hand side of the arch by the clockwise rotation of the feeder wheel 23, and after having passed over the set piece 24, runs around the arch in the counterclockwise direction and is fixed by the hold piece 25 when the end of the band is detected to have passed the hold piece 25. Then, the said feeder wheel 23 is rotated in the counterclockwise direction to free the band from the arch 22, and to wind and tighten the band around the package. After the band has been tightened, the other set piece 24 is used to fix the band. The band is then cut by a cutter (not shown) provided halfway between the hold piece 24 and the feeder wheel 23.

Since the band is fixed by the two set pieces, it does not become loose, but maintains its tension. At a point between the hold piece 24 and the hold piece 25 where the two cut ends of the band meet, a heater (not shown) is inserted between the said two ends to fuse the adhering faces of the band. After removing the heater, the cam wheel 28 is rotated to push the press piece 26 up to effect adhesion of the fused faces of the band. When the band is released from the hold of the hold piece 24 and the hold piece 25, the package can be removed from the arch 22.

Figure 3:
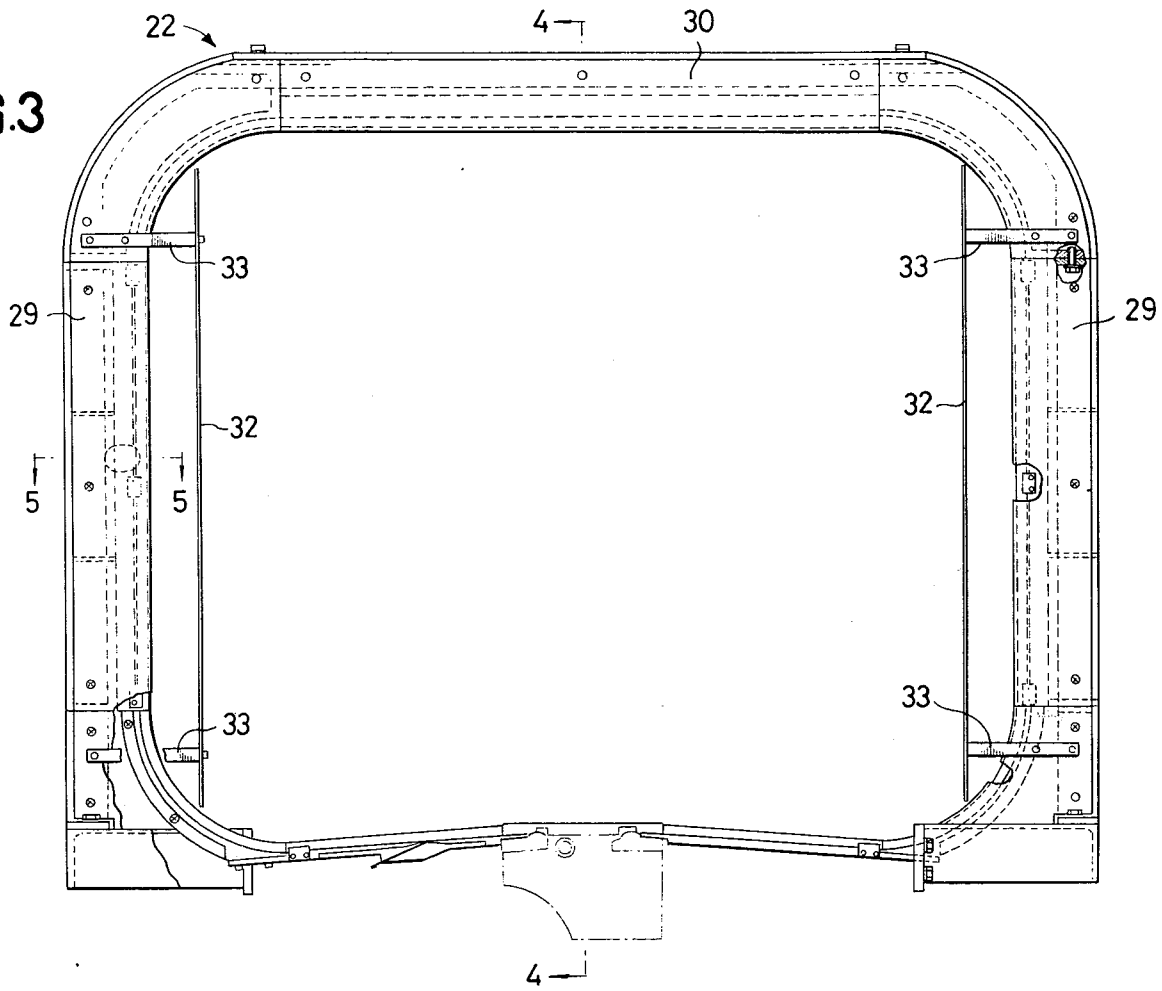
FIG. 3 is a front view of the arch.
Figure 4:
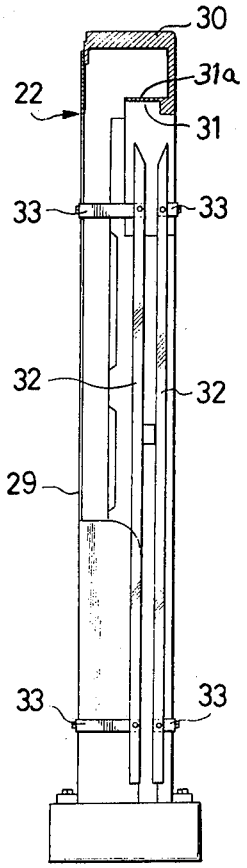
FIG. 4 is a cross-section taken on line 4—4 of FIG. 3.
Figure 5:
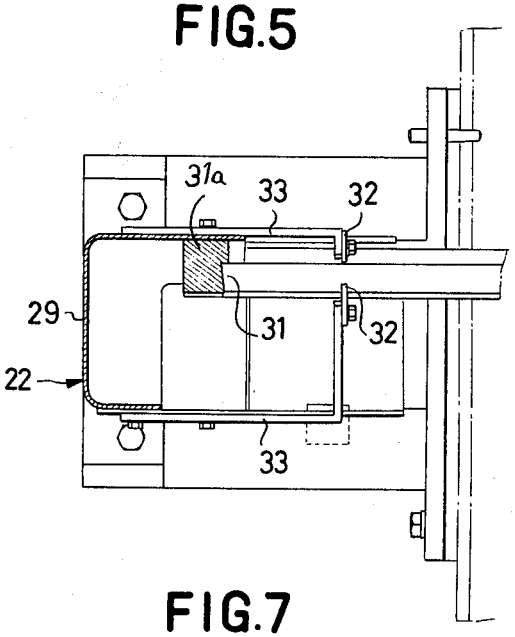
FIG. 5 is a cross-section taken on line 5—5 of FIG. 3.

In FIGS. 3–5, the arch 22 comprises two vertical sides 29 and a horizontal portion 30 connecting the tops of these vertical sides, and is positioned over the band supply hole in the said machine base 21. On the inside of the arch is mounted a channel defining member 31*a* having an inwardly open recess therein for forming a channel 31 for guiding the band during the running of the band around the arch. The bottom of the recess is not level, but rather is inclined inwardly of the arch 22 toward one of the channel side walls.

There are provided two pairs of parallel band guides 32 spaced at a distance corresponding to the band width and one pair being attached to the inside of each of the vertical sides 29 of the said arch by connecting plates 33, the said pairs of guides being parallel to the said vertical sides. FIG. 4 shows the ends of the band guides 32 at an acute angle to each other so that a band coming out of the channel 31 is securely guided into the space between the band guides 32.

Figure 7:
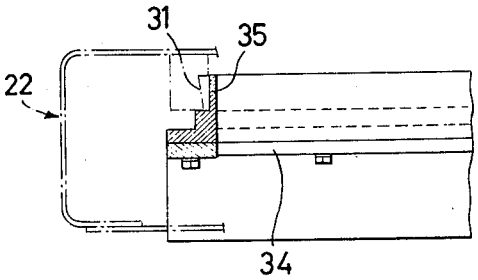
FIG. 7 is a cross-section taken on line 7—7 of FIG. 6.

FIGS. 6–10 show the band holding means 34 covering the recess defining channel 31 of the said arch 22. The said band holding means 34 has a front part shaped substantially the same as the arch 22 and may be advanced or retracted with respect to the channel defining member 31*a* provided on the arch so that it may form a cover plate 35 which, when it is in an advanced position, covers the inner side of the channel to form a closed chamber for the running band, as shown in FIG. 7.

Figure 6:
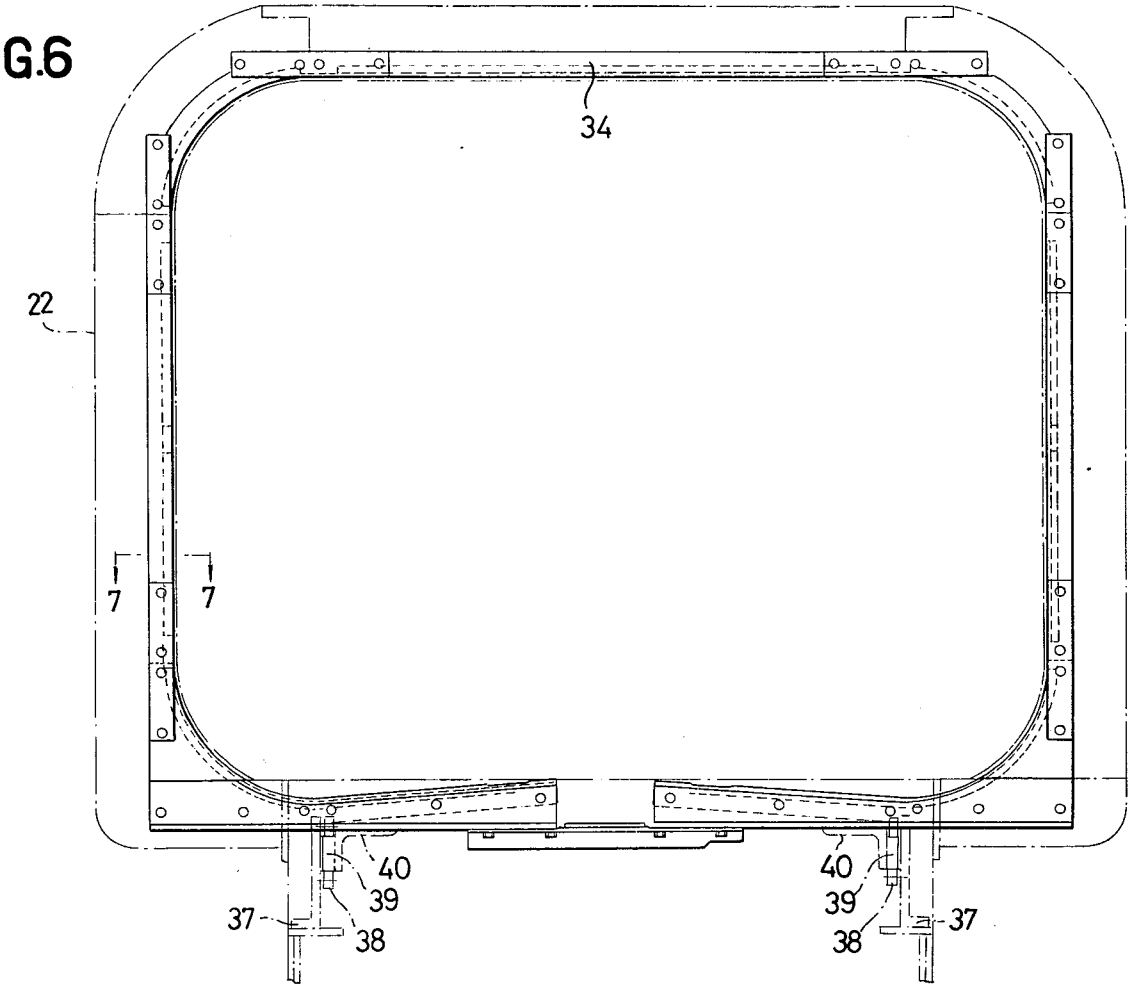
FIG. 6 is a front view of the band holding means in the arch.
Figure 10:
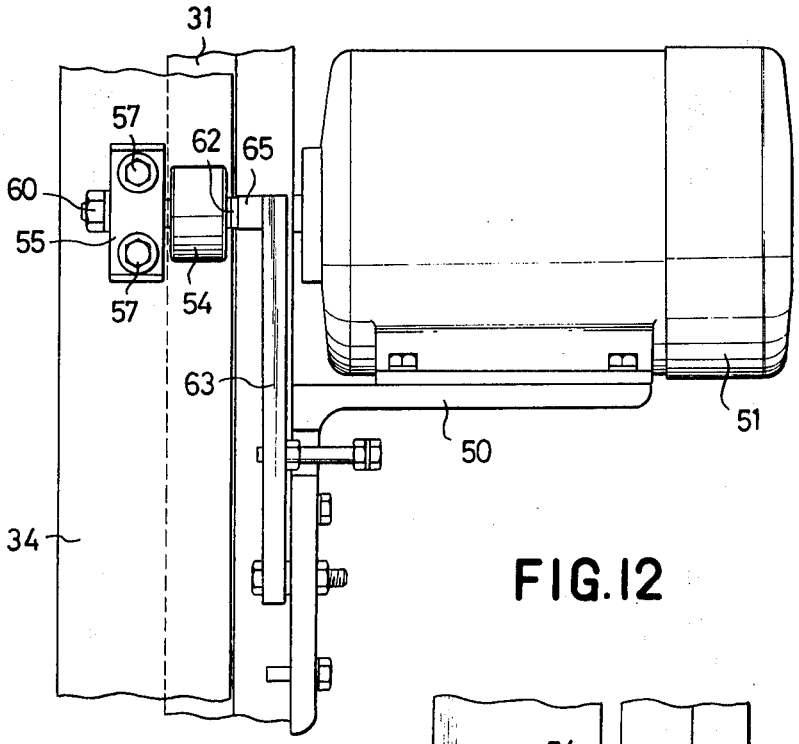
FIG. 10 is a side view, on an enlarged scale, of an auxiliary band feeder attached to the arch.

The said band holding means 34 is connected to a driving device provided within the machine base 21. There are provided two pairs of bearing plates 37 on shelves 36 and along lines in perpendicular relation to the said arch having the ends mounted on the two side walls of the machine base 21. There are also provided two vertically spaced rolls 38 on each plate 37 and projecting laterally of the said bearing plates 37. Two rails 39 are provided on both sides of the machine base 21 perpendicular to the said arch 22 and resting between the rolls 38 for movement in the longitudinal direction thereof. On the inside of the rails are attached attachment members 40 at positions below the arch and in alignment therewith. As shown in FIG. 6, the said band holding means 34 is connected to the attachment members 40 provided on the rails 39.

At the ends of the said rails 39 are provided abutment plates 41. Cams 42 abuttable with the said abutment plates are attached to the shaft 43 rotatably mounted on the machine base 21 in a direction perpendicular to the longitudinal direction of the rails. A bevel gear 44 is provided on the shaft 43 and meshes with a driving bevel gear 45. At the end of the rails 39 where the abutment plates 41 are provided are stops 46, their ends loosely received in receptacles 47 provided on the machine base 21. Rails 39 normally press the stops 46 against receptacles 47 by springs 48 fixed between the machine base and the rails.

When a chamber for the running band is formed by the cover 35 of the band holding means 34 extending to the channel 31 of the arch 22, the rails 39 are pulled by the springs 48 while cams 42 are spaced from the abutment plates 41. The said springs act to cause the stops 46 to abut the receptacles 47.

As described before, the band is supplied by the feeder wheel 23 when the cover 35 of the band holding means 34 reaches the arch channel 31, and the band moves around the arch as it runs through the chamber formed by the channel 31 and the cover 35. As the band goes around the arch and it is detected that the free end has been grasped by band holding piece 25, the driving bevel gear 45 rotates to turn the bevel gear 44, and the cams 42 on the shaft 43 are rotated to push the abutment plates 41 to the right in FIGS. 8 and 9 and to move the rails 39 to the right in FIG. 9 against the action of springs 48. Since the said rails 39 are connected to the band holding means 34, the latter moves along with the former and the cover 35 recedes from the channel 31.

As the feeder wheel 23 is rotated in the opposite direction from the feed direction, the band comes out of the channel 31 and drops vertically being guided by the band guides 32 to tie the package. The band guides 32 guide the band in a direction perpendicular to the package so as to prevent loosening of the band and its coming off the package.

Because the bottom of the said channel 31 is inclined, the band which normally encounters resistance due to friction while it is running will be able to "escape" from such resistance and will be prevented from being stuck in the channel.

Figure 12:
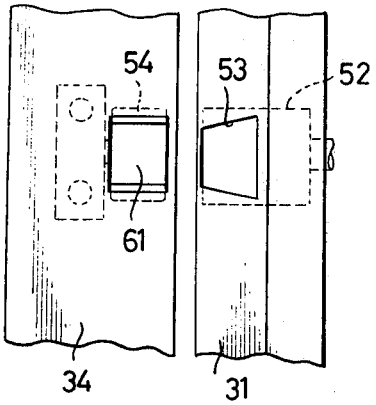
FIG. 12 is a side view of the holes cut respectively in the arch channel and the cover for the band holding means for allowing the driving roll and the push roll to pass therethrough.
Figure 14:
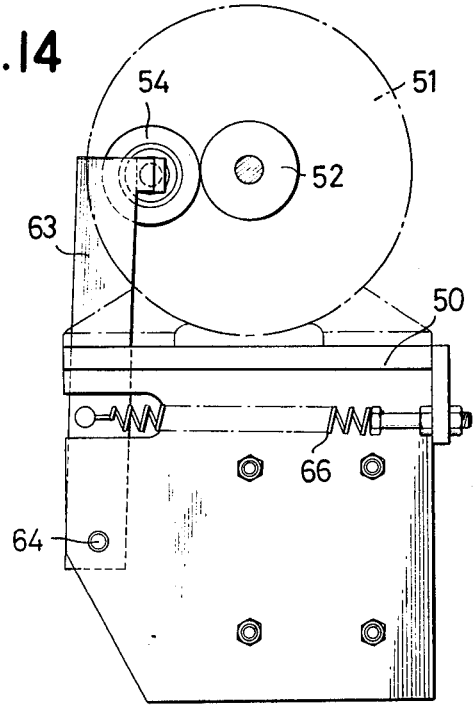
FIG. 14 is a rear view of the said feeder.
Figure 15:
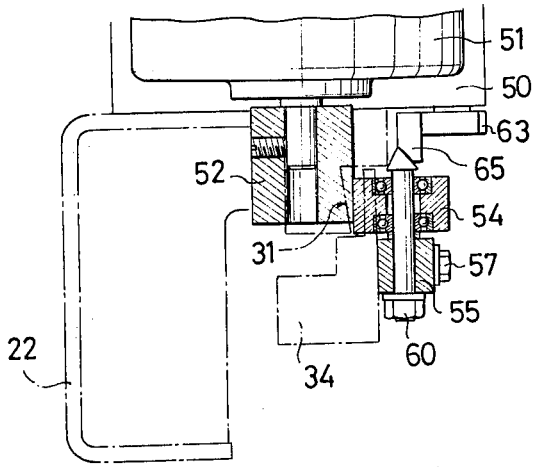
FIG. 15 is a cross-section taken on line 15—15 of FIG. 13.
Figure 16:
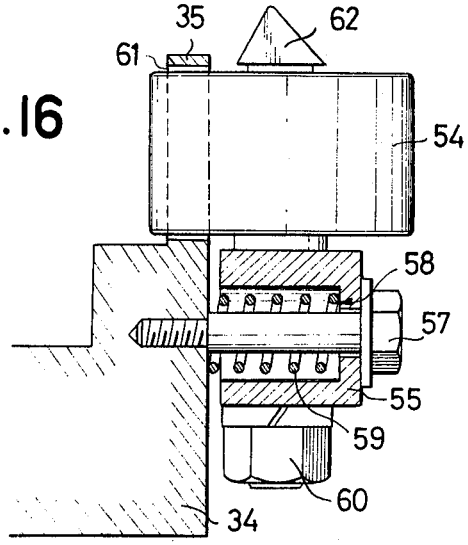
FIG. 16 is a cross-section taken on line 16—16 of FIG. 13.
Figure 17:
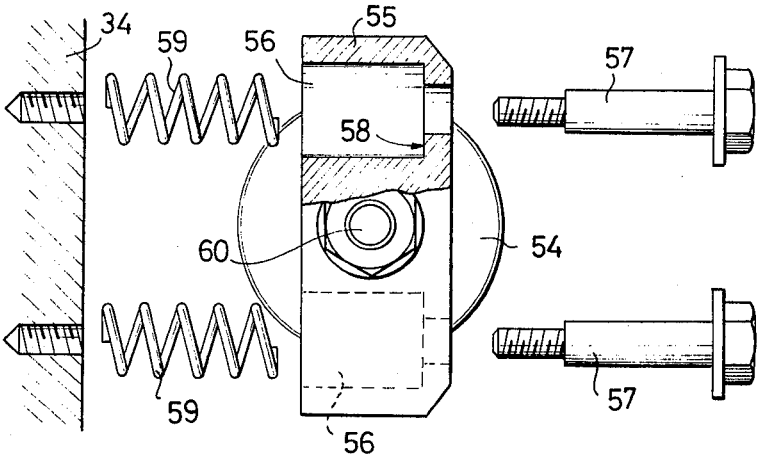
FIG. 17 is an exploded plan view showing of a fixture, springs and bolts for a part of the auxiliary band feeder.

In FIG. 1 the band running inside the arch 22 advances in a counterclockwise direction, and there is provided an auxiliary feeder device 49 to assist the running of the band supplied to the left side vertical section by the band feeder wheel 23. In FIGS. 10–17, there is shown a horizontal bracket 50 behind the arch 22 to which is attached a motor 51. On the shaft of the motor 51 is mounted a driving roll 52 which extends through an opening 53 formed in the channel forming member 31*a* toward the inside of the arch, as shown in FIG. 12, and rotates parallel to the direction of advance of the band.

A press roll 54 is mounted on fixture 55 on the side wall of the band hold means 34 at a position opposed to the said drive roll 52 and parallel thereto. The said fixture 55 has two bolt holes 56 perpendicular to the band advancing direction, through which are inserted bolts 57 to be screwed to the band holding means 34. The said holes 56 have ledges 58 therein, and springs 59 attached to the said bolts 57 are held between the band holding means 34 and the ledges 58 to normally push the fixture 55 away from the band holding means 34.

The said press roll 54 is attached to a roll shaft 60 provided halfway between the holes 56 of the fixture 55 and extending perpendicular thereto, so that press roll 54 will extend toward the inside of the band holding member through a hole 61 formed in the cover 35 when the said fixture 55 is attached to the band holding means 34. The end of the roll shaft 60 extending beyond the press roll 54 is in the shape of a cam 62 having a flat knife-like edge.

A support metal fixture 63 at the same level as the driving roll 52 is pivoted on a pivot 64 on the horizontal bracket 50 on which said motor 51 is mounted. The upper end of the support fixture 63 is movable horizontally and the tip thereof is formed into a support member 65 contacting the cam 62 on the said roll shaft 60. The said support member 65 is formed like a flat knife and faces the said cam 62. Halfway between the pivot 64 and the support means 65 on the said support metal fixture 63 is a spring 66 attached to the mounting bracket 50 to draw the support member toward the driving roll 52. The support metal fixture 63 is stationary as it is engaged with the side wall of the arch 22 by the action of spring 66 and it is allowed to remain free.

When the said band holding means 34 advances toward the channel 31 of the arch 22, the cam 62 on the roll shaft 60 contacts the support member 65 of the support metal fixture 63, and when the band holding means 34 advances to the fullest extent and the cover 35 covers the channel 31, then the pressure roll 54 is pressed laterally against the drive roll 52 rotated by the motor 51, so that the pressure roll 54 rotates with the drive roll 52.

The said auxiliary feeder device is provided at a position where the band supplied to the channel 31 gradually loses the running speed after having run around the arch 22 in order to impart to the band a running force sufficient for the band to reach the final end of the channel 31. This force is imparted by the driving roll 52 as the band passes between the two rolls.

As has been described above, the band holding means 34 recedes and opens the channel so that the band jumps out of the arch when feeder wheel 23 is reversed. At this time, the holding roll 54 is also recedes with the band holding means so as not to interfere with the removal of the band.

In this embodiment, the auxiliary feeder device 49 is provided at the left-hand side of the arch. If one auxiliary feeder device is not enough to help the band reach the end of the arch because of its extra large size, two of them may be attached to the vertical portions 29 of the arch or to the horizontal portion 30.

As has been described above, the present invention is effective in securing the supply of the packing band made of thermo-plastic materials to the banding machine, particularly a machine with a large-sized arch.

What is claimed is:

1. An automatic banding machine for banding a package or the like, comprising a machine base, a band supplying means in said base, an arch on said machine base and projecting therefrom, said arch having a band running channel around the inside periphery thereof opening inwardly of said arch, said band supplying means supplying a band into said band running channel for running the band around said arch and back to said maching base, a band holding means around the inside periphery of said arch and normally covering said channel and movable laterally of said arch for uncovering said channel, driving means coupled to said band holding means for moving said band holding means between the position in which the band holding means covers said channel and the position in which the band holding means leaves said channel uncovered, and an auxiliary band feeder at a position at least halfway around the periphery of said arch in the running direction of the band and having a driving roll projecting toward the inside of said arch into said channel and rotating in the band running direction and a press roll on the band holding means opposed to and having the band pressed into contact therewith by said driving roll when said band holding means is in the position for covering said channel.

2. An automatic banding machine as claimed in claim 1 in which the band running channel is open at one side thereof and the bottom of said channel is inclined outwardly of the periphery of the arch toward the other side thereof.

3. An automatic banding machine as claimed in claim 1 in which said driving means comprises rails movably mounted on said base for movement in the direction of movement of said band holding machine and on which said band holding means is mounted, cam means engaged with the ends of said rails, rotating means on which said cam means is mounted for rotating said cam means, and spring means connected to said rails for holding said rails in engagement with said cam means.

4. An automatic banding machine as claimed in claim 1 in which said auxiliary band feeding device includes a motor on said arch connected to said driving roll.

5. An automatic banding machine as claimed in claim 1 in which said arch extends upwardly from said machine base and has two vertical portions, one on each side thereof, and a horizontal portion connecting the vertical portions, and said machine further comprises two band guides, one adjacent to and parallel to each vertical portion, said band guides having two vertical guide members spaced from each other in the direction of the band width a distance substantially the width of the band and aligned with the band running channel.

* * * * *